US005362601A

United States Patent [19]

Miyake

[11] Patent Number: 5,362,601

[45] Date of Patent: Nov. 8, 1994

[54] HEAT-DEVELOPABLE COLOR PHOTOSENSITIVE MATERIAL

[75] Inventor: Kiyoteru Miyake, Kanagawa, Japan

[73] Assignee: Fuji Photo Film Co., Ltd., Kanagawa, Japan

[21] Appl. No.: 967,051

[22] Filed: Oct. 28, 1992

[30] Foreign Application Priority Data

Oct. 31, 1991 [JP] Japan ..... 3-311498

[51] Int. Cl.[5] ..... G03C 1/20; G03C 1/100

[52] U.S. Cl. ..... 430/203; 430/588; 430/604; 430/605; 430/944; 430/569

[58] Field of Search ..... 430/588, 944, 203, 569, 430/604, 605

[56] References Cited

U.S. PATENT DOCUMENTS 4,948,699 8/1990 Nishinoiri et al. ..... 430/204

5,082,763 1/1992 Kojima et al. ..... 430/203

*Primary Examiner*—Thorl Chea

*Attorney, Agent, or Firm*—Sughrue, Mion, Zinn, Macpeak & Seas

[57] ABSTRACT

A heat-developable photosensitive material includes an infrared-sensitive layer having a maximum spectral sensitivity at a wavelength of 700 nm or longer. A silver chlorobromide emulsion from which the infrared-sensitive layer is formed is prepared by adding an iodide at an intermediate stage during silver halide grain formation or later. The photosensitive material exhibits high sensitivity and low fog while the corresponding emulsion coating composition in solution form remains stable with time.

2 Claims, No Drawings

HEAT-DEVELOPABLE COLOR PHOTOSENSITIVE MATERIAL

TECHNICAL FIELD

This invention relates to a heat-developable color photosensitive material and more particularly, to a heat-developable color photosensitive material having infrared spectral sensitivity. The material is often used in a system using semiconductor laser as an exposure light source as incorporated in color hard copiers and printers. In particular, the material has high sensitivity and low fog in the infrared region and is easy to manufacture.

BACKGROUND OF THE INVENTION

Heat-developable photosensitive material is well known in the art. The heat-developable photosensitive material and its process are described in the literature and patents, for example, "Shasinkougaku No Kiso" —Higinen Shasin— ("Fundamentals of Photographic Engineering" —Non-Silver Salt Photography—), 1982, Corona Publishing K.K., pages 242–255 and U.S. Pat. No. 4,500,626 which is incorporated herein by reference. In addition, a method of forming dye images through coupling reaction with an oxidant of a developing agent is described in U.S. Pat. Nos. 3,761,270 and 4,021,240.

It was also proposed to imagewise release or form a diffusible dye through heat development and transfer the dye to a dye fixing element. With this technique, either negative or positive dye images can be obtained by selecting a suitable type of dye-providing compound or a suitable type of silver halide. For detail, reference is made to U.S. Pat. No. 4,500,626, 4,483,914, 4,503,137, 4,559,290; Japanese Patent Application Kokai (JP-A) Nos. 149046/1983, 218443/1984, 133449/1985, and 238056/1986; EP 210660 A2 and 220746 A2; Japan Invention Society's Kokai Giho (Technical Report) No. 87-6199 and the like.

A variety of proposals have been made in the art for producing positive color images through heat development. For example, U.S. Pat. No. 4,559,290 proposes a method for forming an image by converting a dye providing (DRR) compound into an oxidized form having no dye releasing ability, preparing a heat-developable material in which the oxidized DRR compound is co-present with a reducing agent or a precursor thereof, carrying out heat development to oxidize the reducing agent in an amount corresponding to the exposure of silver halide, and allowing the remainder of the reducing agent unoxidized to reduce the oxidized DRR compound into the DRR compound to release a diffusible dye. EP-A 220,746 and Technical Report No. 87-6199 (Vol. 12, No. 22) describe a compound capable of releasing a diffusible dye through a similar mechanism, more particularly a heat-developable color photosensitive material using a compound capable of releasing a diffusible dye through reductive cleavage of an N-X linkage where X is an oxygen, nitrogen or sulfur atom.

It is known that the heat-development process often entails fog, known as thermal fog, which is not expectable from conventional wet development or processing in a liquid developer. The thermal fog is a serious problem against image formation. The thermal fog increases the minimum density in heat-developable photosensitive material of the negative type forming color images in proportion to latent images, resulting in white areas becoming tarnished. It decreases the maximum density in heat-developable photosensitive material of the positive type forming color images in counter-proportion to latent images. The thermal fog is one of main factors prohibiting sensitivity increase since it tends to occur particularly when an emulsion containing silver halide grains of a larger size is used in order to provide high sensitivity.

For preventing the thermal fog, it is a common practice in the prior art to use organic compounds known as antifoggants. Conventional antifoggants, however, suffer from several problems since some are less effective for suppressing fog and some suppress fog, but retard development at the same time.

Particularly when a photosensitive material having a spectral sensitivity peak in the infrared region is desired, it is prohibited to use a sufficient amount of an effective antifoggant since infrared sensitizing dyes do not generally provide so strong adsorption to silver halide. Differently stated, if an effective antifoggant is used in a sufficient amount, it would restrain adsorption of the sensitizing dye, resulting in reduced sensitivity. In addition, there is a potential serious problem that aging of an emulsion coating composition in solution form would cause desorption of the dye, resulting in reduced sensitivity. In this way, an attempt to suppress fog would aggravate the stability of an emulsion coating composition during solution form aging whereas an attempt to improve the stability of an emulsion coating composition during solution form aging by reducing the amount of antifoggant used would eventually invite increased fog. It was thus difficult in heat development to achieve fog suppression and to stabilize an emulsion coating composition during solution form aging at the same time.

For this reason and other, there exists no definite design guideline for heat-developable color photosensitive material to achieve high sensitivity and low fog while satisfying manufacturing feasibility. It is thus desired to develop a heat-developable color photosensitive material comprising an emulsion which is characterized by high sensitivity and low fog as well as the stability of its coating solution with the lapse of time.

SUMMARY OF THE INVENTION

Therefore, an object of the present invention is to provide an emulsion for heat-developable color photosensitive material having improved stability of an emulsion coating composition during aging in solution form and thereby to provide a heat-developable color photosensitive material having high sensitivity and manufacturing feasibility.

To achieve this and other objects, the present invention provides a heat-developable color photosensitive material comprising at least a photosensitive silver halide emulsion, a binder and a dye-providing compound on a support. The photosensitive material includes at least one infrared-sensitive layer which has a maximum spectral sensitivity at a wavelength of 700 nm or longer. At least one of such infrared-sensitive layers contains a silver chlorobromide emulsion which is prepared by adding an iodide at an intermediate stage during grain formation or later.

Preferably, the silver chlorobromide emulsion contains iridium. Also preferably, the infrared-sensitive layer containing a silver chlorobromide emulsion is spectrally sensitized such that the spectral sensitivity to light having a wavelength 20 nm longer than the wavelength giving the maximum spectral sensitivity is up to one third of the maximum spectral sensitivity. Spectral sensitization favors thiadicarbocyanine sensitizing dyes of formula (I) which will be defined later.

DETAILED DESCRIPTION OF THE INVENTION

The heat-developable color photosensitive material comprising a binder and a dye-providing compound on a support according to the present invention includes at least one infrared-sensitive layer which has a maximum spectral sensitivity at a wavelength of 700 nm or longer. At least one of such infrared-sensitive layers contains a silver chlorobromide emulsion which is prepared by adding an iodide at an intermediate stage during grain formation or later.

First the silver halide emulsion used in the present invention is described.

(1) Basic construction and preparation of silver halide grains

The silver chlorobromide used herein is a silver halide containing up to 1 mol % of iodine including the amount of an iodide added and encompasses silver chloride and silver bromide. Inclusion of thiocyanates is acceptable. The silver chlorobromide prior to the addition of an iodide should be free of iodine.

The benefits of the invention are available with only the above-defined silver chlorobromide, but not with silver chlorobromide containing in excess of 1 mol % of iodine.

The silver halide emulsion used herein may be either of the surface latent image type or the internal latent image type. The internal latent image type emulsion is used as a direct reversal emulsion combined with a nucleating agent and secondary exposure or chemical fogging. Also included are multi-structure grains having a varying halogen composition between the grain interior and surface. Among the multi-structure grains, the double-structure grains are generally designated core-shell grains.

Preferably the silver halide emulsion is a monodispersed emulsion though not limited thereto. It preferably has a coefficient of variation (standard deviation divided by average side length) of up to 20%, more preferably up to 16%, most preferably up to 10% as defined in JP-A 110555/1991.

The silver halide grains preferably have a mean particle size of 0.1 to 2.2 μm, more preferably 0.1 to 1.2 μm, most preferably 0.1 to 0.8 μm.

As to crystal habit, the grains may take the form of cube, octahedron, plate having a high aspect ratio, potato or the like.

At a silver halide grain forming stage, nitrogenous compounds may be added as described in JP-B 7781/1971 and JP-A 222842/1985 and 122935/1985.

During or after formation of silver halide grains, the grains on the surface may be treated with bromide to substitute bromine for chlorine in the grains.

In the practice of the invention, at a silver halide grain forming stage, silver halide solvents may be used such as thiocyanates, $NH_3$, thioureas, organic thioether derivatives as described in JP-B 11386/1972, and sulfur-containing compounds as described in JP-A 144319/1978. More particularly, there may be used any of the silver halide solvents described in U.S. Pat. No. 4,500,626, 4,628,021, Research Disclosure, 17029 (1978), and JP-A 25159/1987.

In the process of preparing a silver halide emulsion according to the present invention, a desalting step may be carried out for removing the excess salt. The desalting step may be carried out by the old noodle washing technique involving gelatin gelation or by flocculation techniques using inorganic salts of polyvalent anions such as sodium sulfate, anionic surfactants, anionic polymers (e.g., polystyrenesulfonic acid), or gelatin derivatives (e.g., aliphatic acylated gelatin, aromatic acylated gelatin, and aromatic carbamoylated gelatin). It is preferred to apply a flocculation technique using a compound (P-1) or (P-2) as shown below although the invention is not limited thereto. The excess salt removal may be omitted in some cases. Alternatively, excess salt may be removed by ultrafiltration means as disclosed in U.S. Pat. No. 4,758,505 and 4,334,012, JP-A 113137/1987, and JP-B 43727/1984. The use of (P-1) is preferred for adsorption of infrared sensitizing dyes having a spectral sensitivity peak wavelength of 700 nm or longer.

(P-1)

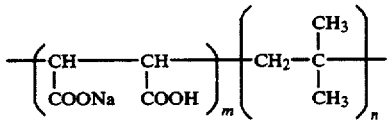

(P-2)

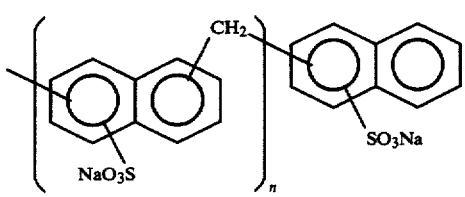

The silver halide emulsion used herein may contain any desired heavy metal, for example, iridium, rhodium, platinum, cadmium, zinc, thallium, lead, iron, chromium, ruthenium, and rhenium for various purposes. Heavy metal compounds may be used alone or in admixture of two or more. They are generally added in amounts of about $10^{-9}$ to $10^{-3}$ mol per mol of silver halide, but may be added in larger or less amounts as necessary. When used, they may be introduced into grains either uniformly or locally, that is, only at the surface or inside. Introduction of iridium is especially preferred.

In the preparation of the silver halide emulsion according to the present invention, gelatin is advantageously used as protective colloid and as a binder for other hydrophilic colloids. The use of other hydrophilic colloids is also acceptable. Useful are gelatin derivatives, graft polymers of gelatin with other polymers, proteins such as albumin and casein; cellulose derivatives such as hydroxyethyl cellulose and cellulose sulfate ester, sodium alginate and starch derivatives; and various other synthetic hydrophilic polymers such as polyvinyl alcohol, polyvinyl alcohol partial acetal, poly-N-vinyl pyrrolidone, polyacrylic acid, polymethacrylic acid, polyacrylamide, polyvinylimidazole, and polyvinylpyrazole, alone or copolymers thereof.

Examples of the gelatin used include lime treated gelatin, acid treated gelatin, and enzyme treated gelatin as described in Bull. Soc. Sci. Phot., Japan, No. 16, p. 30 (1966) as well as hydrolyzed and enzymatically decomposed products of gelatin.

With respect to other conditions, reference is made to P. Grafkides, "Chimie et Physique Photographique", Paul Montel, 1967; G. F. Duffin, "Photographic Emulsion Chemistry", The Focal Press, 1966, V. L. Zelikman et al., "Making and Coating Photographic Emulsion", The Focal Press, 1964, and the like. More particularly, acidic, neutral and ammoniacal methods may be used. The mode of reacting a soluble silver salt with a soluble halide may be single jet mixing, double jet mixing or a combination thereof. It is also employable to form grains in the presence of excess silver, which is known as reverse mixing method. One special type of the double jet technique is by maintaining constant the pAg of a liquid phase in which silver halide is created, which is known as a controlled double jet technique.

Also silver halide grain growth can be accelerated by increasing the flow rate, amount and concentration of the silver salt and halide solutions added as disclosed in JP-A 142329/1980 and 158124/1980 and U.S. Pat. No. 3,650,757.

During formation of silver halide grains, the reaction solution may be agitated by any well-known agitation method and maintained at any desired temperature and pH.

(2) Addition of iodide

An iodide is added to the silver halide emulsion according to the present invention. The iodide may be any compound which can introduce iodine into silver chlorobromide grains. Preferred are water-soluble iodides, for example, KI, NaI, LiI, $NH_4I$, $CaI_2$, $MgI_2$, $BaI_2$, and RbI. The solvent for the iodide may be organic solvents such as methanol as well as water. Those iodides substantially insoluble in water such as AgI are also acceptable. Very fine particles of AgI having a size of less than 0.1 μm can be advantageously used like water-soluble iodides such as KI.

The iodide is added at any time during or after silver halide grain formation, that is, at an intermediate stage during grain formation or later. More particularly, the iodide is added during or after grain formation, during a desalting step, before, during or after chemical sensitization, or during preparation of an emulsion coating composition.

Where the iodide is added on the way of forming grains, it is preferred to introduce the iodide after at least 12.5% of silver based on the overall soluble silver has been added, most preferably after at least 87.5% of silver based on the overall soluble silver has been added. Where the iodide is added after grain formation, it is preferred to add the iodide within 5 minutes from the completion of grain formation. Where the iodide is added during and/or after grain formation, a sensitizing dye may be added at any stage, during or after grain formation, during desalting, before, during or after chemical sensitization, or during preparation of an emulsion coating composition, preferably during or after grain formation or before, during or after chemical sensitization. The iodide may be added prior to, subsequent to or at the same time as the addition of the sensitizing dye. Where the iodide is added at the same time as the sensitizing dye, the iodide may be mixed with the sensitizing dye solution.

Where the iodide is added before, during or after chemical sensitization, preferably the sensitizing dye is also added before, during or after chemical sensitization. The iodide may be added prior to, subsequent to or at the same time as the addition of the sensitizing dye. Preferably the iodide is added within 10 minutes, especially within 5 minutes, before or after the addition of the sensitizing dye. This includes a situation where the iodide is added at the same time as the sensitizing dye. In such a situation, the iodide is preferably mixed with the sensitizing dye solution.

The amount of iodide added preferably ranges from 1 mol % to 0.001 mol % based on the silver halide. More preferably the amount ranges from 1 to 0.05 mol % when the iodide is added before or during the desalting step and from 0.2 to 0.001 mol % when the iodide is added after the desalting step.

(3) Type and addition method of sensitizing dye

The sensitizing dyes used herein include cyanine dyes, merocyanine dyes, complex cyanine dyes, complex merocyanine dyes, holopolar cyanine dyes, hemicyanine dyes, styryl dyes, and hemioxonol dyes. Exemplary sensitizing dye are described in U.S. Pat. No. 4,617,257, JP-A 180550/1984 and 140335/1985, and RD 17029 (1978), pages 12–13. These sensitizing dyes may be used alone or in combination. Combinations of sensitizing dyes are often used particularly for the purpose of supersensitization.

In addition to the sensitizing dye, the emulsion may contain a dye which itself has no spectral sensitization function or a compound which does not substantially absorb visible light, but is capable of supersensitization (see U.S. Pat. No. 3,615,641 and Japanese Patent Application No. 226294/1986).

The sensitizing dye may be added at the onset of, during or after silver halide grain formation (addition prior to nuclear formation is acceptable), or at the onset of, during or after a desalting step, during gelatin redispersion, before, during or after chemical sensitization, or during preparation of an emulsion coating composition. Preferably, the sensitizing dye is added during or after silver halide grain formation or before, during or after chemical sensitization. The addition after chemical sensitization means that the sensitizing dye is added after the chemical substances necessary for chemical sensitization have been added.

In any of the above-mentioned addition procedures, the sensitizing dye may be added all at once or in divided portions. Furthermore, the sensitizing dye may be added in admixture with a soluble silver salt and/or halide.

The sensitizing dye may be added either above or below the surface of a solution while the solution be agitated by any conventional agitation means.

The sensitizing dye may be added by dissolving it in a water-miscible organic solvent such as methanol, ethanol, propanol, fluorinated alcohols, methyl cellosolve, dimethylformamide, and acetone, or water (which may be alkaline or acidic), or a mixture thereof. Alternatively, the sensitizing dye may be added by dispersing it in a water/gelatin dispersion or in the form of freeze dried powder. A powder or dispersion of the sensitizing dye dispersed with a surfactant may also be used.

The sensitizing dye used in the emulsion according to the invention is any of those sensitizing dyes having a spectral sensitivity peak at a wavelength of 700 nm or longer, for example, those described in Japanese Patent Application Nos. 100102/1990 and 137885/1990.

In one preferred embodiment, the silver chlorobromide emulsion is spectrally sensitized such that the spectral sensitivity to light having a wavelength 20 nm longer than the wavelength giving the maximum spectral sensitivity is up to one third of the maximum spectral sensitivity.

More preferably, spectral sensitization uses a thiadicarbocyanine sensitizing dye of the following general formula (I):

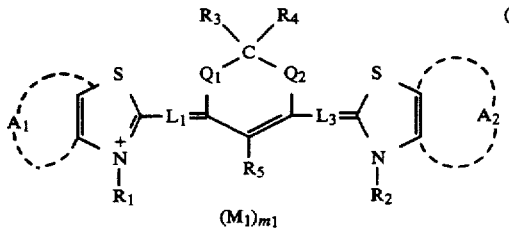

(I)

wherein $Q_1$ and $Q_2$ each are a methylene radical $R_1$ and $R_2$ each are an alkyl radical, $R_3$, $R_4$ and $R_5$ are independently selected from the group consisting of a hydrogen atom, alkyl radical, aryl radical and heterocyclic radical, with the proviso that both $R_3$ and $R_4$ are not hydrogen atoms at the same time, $L_1$ and $L_3$ each are a methine radical, $A_1$ and $A_2$ each are a group of atoms necessary to form a benzene or naphthalene ring, $R_1$ and $L_1$, and $R_2$ and $L_3$, taken together, may form a ring, $M_1$ is an electric charge balancing counter ion, and $m_1$ is a value necessary to neutralize the electric charge.

The alkyl radicals represented by $R_1$ and $R_2$ may be substituted or unsubstituted ones, preferably having 1 to 18 carbon atoms, for example, methyl, ethyl, propyl, butyl, pentyl, octyl, decyl, dodecyl and octadecyl radicals. Substituents on these alkyl radicals include sulfonate, carboxy and cyano radicals.

$R_1$ taken together with $L_1$ may form a ring. Similarly $R_2$ taken together with $L_3$ may form a ring. Preferably, they are carbon atoms forming an unsubstituted 5, 6 or 7-membered ring, especially carbon atoms forming an unsubstituted 6-membered ring.

Preferably, $R_1$ and $R_2$ are unsubstituted alkyl radicals (e.g., methyl, ethyl, n-propyl and n-butyl radicals) and sulfoalkyl radicals (e.g., 2-sulfoethyl, 3-sulfopropyl, 4-sulfobutyl and 3-sulfobutyl radicals). Alternatively, $R_1$ and $L_1$, and $R_2$ and $L_3$, taken together, may form a 5 or 6-membered ring.

Among the radicals represented by $R_3$, $R_4$ and $R_5$, the alkyl radicals may be substituted or unsubstituted ones, preferably having 1 to 10 carbon atoms, for example, methyl and ethyl radicals; the aryl radicals may be substituted or unsubstituted ones, for example, phenyl radicals; and the heterocyclic radicals are, for example, 2-pyridyl, 2-thiazoyl, 2-furyl and 2-quinolyl radicals. Preferably, $R_3$, $R_4$ and $R_5$ are hydrogen atoms, methyl, ethyl or phenyl radicals.

The benzene or naphthalene rings formed by $A_1$ and $A_2$ may be substituted or unsubstituted ones. Substituents on these rings include halogen atoms such as chloro; a hydroxy radical; alkyl radicals such as methyl; alkoxy radicals such as methoxy and ethoxy; aryl radicals such as phenyl; a carboxy radical; a cyano radical; an amino radical; and a sulfonate radical.

Ions represented by $M_1$ include halide ions such as bromide and iodide ions; anions such as perchlorate and para-toluenesulfonate ions;, and cations such as triethylammonium and sodium ions.

It will be understood that $m_1$ is equal to 0 when the dye itself forms an internal salt to retain electric charge balance.

Preferred examples of the infrared spectral sensitizing dye are shown below although the invention is not limited to them.

One preferred class of infrared spectral sensitizing dye includes those of formula (II):

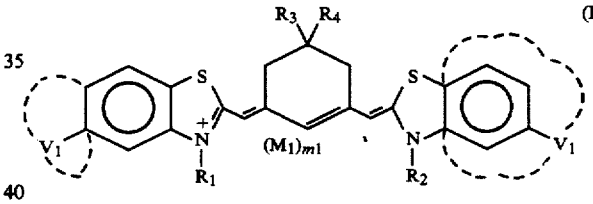

(II)

wherein $R_1$, $R_2$, $R_3$, $R_4$, $V_1$, $M_1$ and $m_1$ have the following meanings. Examples of formula (II) dye are given below as dyes D-1 through D-20.

| Dye No. | $R_1$ | $R_2$ | $R_3$ | $R_4$ | $V_1$ | $M_1$ | $m_1$ |
|---|---|---|---|---|---|---|---|
| D-1 | $C_2H_5$ | $C_2H_5$ | $CH_3$ | H | H | $I^-$ | 1 |
| D-2 | " | " | " | " | Cl | $Cl.O_4^-$ | 1 |
| D-3 | " | " | " | " | $CH_3$ | " | 1 |
| D-4 | " | " | " | " | $OCH_3$ | 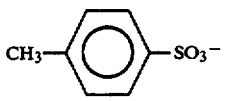 | 1 |
| D-5 | " | " | " | " | $OC_2H_5$ | $I^-$ | 1 |
| D-6 | $(CH_2)_3SO_3^-$ | $(CH_2)_3SO_3^-$ | " | " | H | $HN(C_2H_2)_3^+$ | 1 |
| D-7 | $C_2H_5$ | $C_2H_5$ | 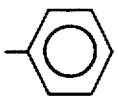 | " | $CH_3$ | $I^-$ | 1 |
| D-8 | " | " | " | " | $OCH_3$ | $I^-$ | 1 |
| D-9 | $(CH_2)_3SO_3^-$ | $(CH_2)_3SO_3^-$ | " | " | " | $HN(C_2H_5)_3^+$ | 1 |
| D-10 | $C_2H_5$ | $(CH_2)_3SO_3^-$ | " | " | H | — | — |

-continued

| Dye No. | $R_1$ | $R_2$ | $R_3$ | $R_4$ | $V_1$ | $M_1$ | $m_1$ |
|---|---|---|---|---|---|---|---|
| D-11 | $C_2H_5$ | $C_2H_5$ | 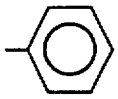 | " | $OC_2H_5$ | $ClO_4^-$ | 1 |
| D-12 | " | " | $CH_3$ | $CH_3$ | H | $I^-$ | 1 |
| D-13 | n-$C_4H_9$ | n-$C_4H_9$ | 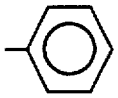 | H | H | $I^-$ | 1 |
| D-14 | $(CH_2)_3SO_3^-$ | $(CH_2)_3SO_3^-$ | $CH_3$ | H | $CH_3$ | $HN(C_2H_5)_3^+$ | 1 |
| D-15 | " | " | " | " | $OCH_3$ | " | 1 |
| D-16 | $C_2H_5$ | $C_2H_5$ | $C_2H_5$ | " | H | $I^-$ | 1 |
| D-17 | $(CH_2)_3SO_3^-$ | $(CH_2)_3SO_3^-$ | " | " | $OCH_3$ | $HN(C_2H_5)_3^+$ | 1 |
| D-18 | $C_2H_5$ | $C_2H_5$ | 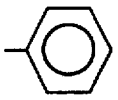 | " | H | $I^-$ | 1 |
| D-19 | " | " | " | " | " | 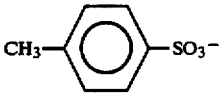 | 1 |
| D-20 | $(CH_2)_4SO_3^-$ | $(CH_2)_4SO_3^-$ | " | " | " | $HN(C_2H_5)_3^+$ | 1 |

Similar examples of the dye of formula (I) wherein $R_1$ and $R_2$ form 6-membered rings with $L_1$ and $L_3$, respectively, are given below as dyes D-21 to D-23.

D-21

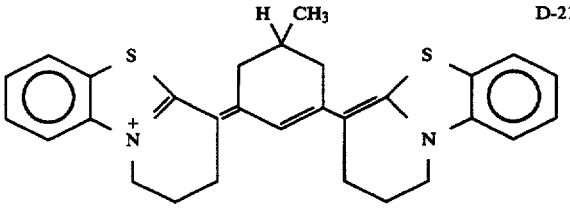

$I^-$

D-22

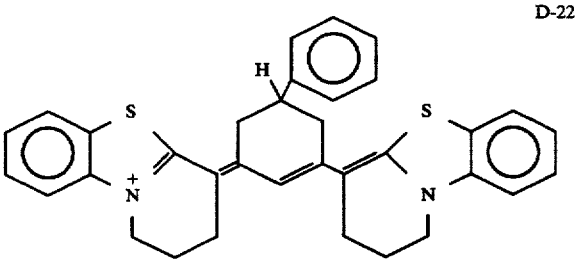

$ClO_4^-$

-continued

D-23

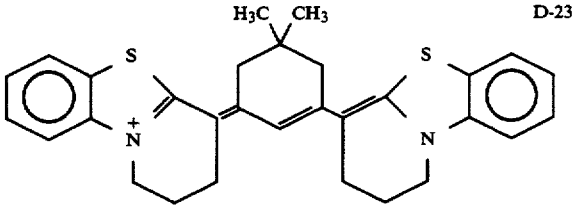

$Br^-$

Another preferred class of infrared spectral sensitizing dye includes those of formula (III):

(III)

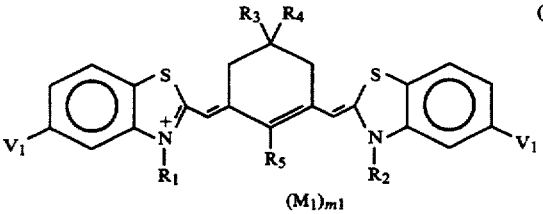

wherein $R_1$, $R_2$, $R_3$, $R_4$, $R_5$, $V_1$, $M_1$ and $m_1$ have the following meanings. Examples of formula (III) dye are given below as dyes D-24 through D-32.

| Dye No. | $R_1$ | $R_2$ | $R_3$ | $R_4$ | $R_5$ | $V_1$ | $M_1$ | $m_1$ |
|---|---|---|---|---|---|---|---|---|
| D-24 | $C_2H_5$ | $C_2H_5$ | H | $CH_3$ | $CH_3$ | H | $I^-$ | 1 |
| D-25 | " | " | H | 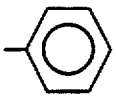 | $CH_3$ | " | " | 1 |
| D-26 | n-$C_4H_9$ | n-$C_4H_9$ | " | " | " | " | " | 1 |
| D-27 | $(CH_2)_3SO_3^-$ | $(CH_2)_3SO_3^-$ | " | " | " | " | $Na^+$ | 1 |

-continued

| Dye No. | $R_1$ | $R_2$ | $R_3$ | $R_4$ | $R_5$ | $V_1$ | $M_1$ | $m_1$ |
|---|---|---|---|---|---|---|---|---|
| D-28 | $(CH_2)_4SO_3^-$ | $C_2H_5$ | " | " | " | " | — | — |
| D-29 | $C_2H_5$ | $C_2H_5$ | " | $CH_3$ | " | $OCH_3$ | 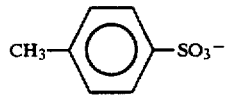 | 1 |
| D-30 | " | " | " | " | " | $OC_2H_5$ | $ClO_4^-$ | 1 |
| D-31 | " | " | " | 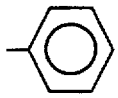 | " | " | I | 1 |
| D-32 | " | " | " | " | " | $OCH_3$ | I | 1 |

Other examples are dyes D-33 to D-35 given below. These dyes are effective for providing a spectral sensitivity peak at a wavelength of longer than 800 nm.

D-33

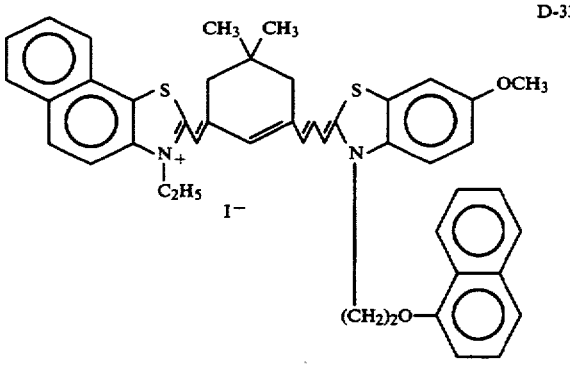

D-34

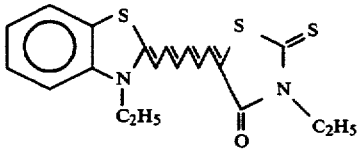

D-35

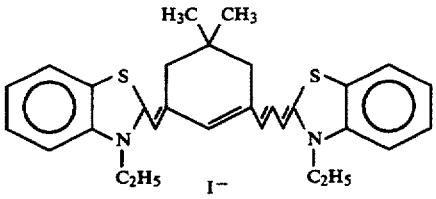

Among these dyes, dyes D-1 through D-32 have the advantages of sharp spectral sensitivity and excellent color separation. However, since the wavelength at which the maximum spectral sensitivity appears tends to shift with time during aging of an emulsion coating composition in solution form, there entails a substantial lowering of sensitivity with time for no other reason but that the spectral sensitivity is sharp. The present invention is effective with these sensitizing dyes D-1 through D-32 since an emulsion prepared by adding an iodide at an intermediate stage during silver halide grain formation or later remains stable in coating solution form over a sufficient period of time. Thus the sharp spectral sensitivity inherent to each of these dyes is well retained.

Preferably, the amount of sensitizing dye used ranges from 0.001 to 20 grams, more preferably from 0.01 to 2 grams per 100 grams of silver used in the emulsion preparation. In the reaction procedure of forming silver halide grains, the sensitizing dye should preferably be present in the reaction solution at a concentration of up to 2% by weight, more preferably up to 0.5% by weight.

(4) Chemical sensitization

The silver halide emulsion used herein may be used without post ripening or chemical sensitization although it is advantageous to chemically sensitize the emulsion for enhanced sensitivity. The chemical sensitization may be by sulfur, gold and reduction sensitization methods and combinations thereof. Such chemical sensitization may be combined with chalcogenide sensitization using chalcogenides (other than sulfur) such as selenium and tellurium and noble metal sensitization using palladium, iridium or similar noble metals.

In one preferred procedure, inhibitors such as 4-hydroxy-6-methyl-(1,3,3a,7)-tetraazaindene are added at the onset of, during or after chemical sensitization.

Sulfur sensitizers are those sulfur compounds capable of reacting with active gelatin and silver, for example, thiosulfates, allyl thiocarbamide, thiourea, allyl isothiacyanate, cystine, p-toluenethiosulfonate, thiocyanates, and mercapto compounds. Other useful compounds are described in U.S. Pat. No. 1,574,944, 2,410,689, 2,278,947, 2,728,668, and 3,656,955.

In the practice of the invention, the photosensitive silver halide is coated in a weight of 1 to 10 grams of silver per square meter.

In combination with the photosensitive silver halide, an organic metal salt may be used as an oxidizing agent. Preferred organic metal salts are organic silver salts. Exemplary organic silver salts are those obtained from benzotriazoles, fatty acids and other organic compounds as disclosed in U.S. Pat. No. 4,500,626, col. 52–53. Also useful are silver salts of carboxylic acids having an alkynyl group such as phenylpropiolic acid as described in JP-A 113235/1985 and acetylene silver as described in JP-A 249044/1986. A mixture of two or more organic silver salts may also be used. The organic silver salt is preferably used in an amount of 0.01 to 10 mol, more preferably 0.01 to 1 mol per mol of photosensitive silver halide. The total coverage of photosensitive silver halide plus organic silver salt may range from 50 $mg/m^2$ to 10 $g/m^2$ calculated as silver.

Various antifoggants or photographic stabilizers may be used in the emulsion. Useful examples are azoles and azaindenes as described in RD 17643 (1973), pages 24–25, nitrogenous carboxylic acids and phosphoric acids as described in JP-A 168442/1984, mercapto compounds and metal salts thereof as described in JP-A 111636/1984, and acetylene compounds as described in JP-A 87957/1987. The antifoggants are generally used in a total amount of $1\times10^{-7}$ to 10 mol, preferably $1\times10^{-4}$ to 1 mol, more preferably $1\times10^{-3}$ to $2\times10^{-1}$ mol per mol of silver halide.

In the practice of the present invention, the photosensitive material or dye fixing element includes a layer which contains a hydrophilic binder, for example, such as described in JP-A 253159/1987. More specifically, transparent or semi-transparent hydrophilic binders are preferred, for example, proteins such as gelatin and gelatin derivatives; cellulose derivatives; natural compounds like polysaccharides such as starch, gum arabic, dextran and pluran; and synthetic hydrophilic polymers including polyvinyl alcohol, polyvinylpyrolidone and polyacrylamide. Also useful are the hygroscopic polymers described in JP-A 245260/1987, which include a homopolymer of a vinyl monomer having —COOM or —$SO_3M$ wherein M is a hydrogen atom or alkali metal, or copolymers of the vinyl monomer with another vinyl monomer such as sodium methacrylate and ammonium methacrylate (commercially available as Sumicagel L-5H by Sumitomo Chemical K.K.). These binders may be used in admixture of two or more.

In a system wherein a minor amount of water is fed to allow for heat development, the use of hygroscopic binders as mentioned above is effective for promoting water absorption. Also, if a hygroscopic polymer is used in a dye fixing layer or a protective layer therefor, it is effective for preventing the once transferred dye from re-transferring from the dye fixing layer to another layer.

Preferably the binder is coated in an amount of up to 20 g/m$^2$, more preferably up to 10 g/m$^2$, most preferably up to 7 g/m$^2$.

The photosensitive material or dye fixing element includes layers (inclusive of a back layer) which may contain various polymer latexes for the purposes of improving film properties such as dimensional stability and preventing curling, sticking, crazing and pressure sensitization/desensitization. Any of the polymer latexes described in JP-A 245258/1987, 136648/1987 and 110066/1987 may be used. It is particularly effective to add a polymer latex having a low glass transition temperature (below 40° C.) to a mordant layer for preventing the mordant layer from crazing and to add a polymer latex having a high glass transition temperature to a back layer for anti-curling effect.

Any of the reducing agents which are known in the heat-developable photosensitive material field may be used herein. There are included in the reducing agent concept dye-providing substances having reducing nature as will be described later (in this case, another reducing agent may be additionally used). Also useful are reducing agent precursors which themselves have no reducing nature, but exert reducing nature under the action of nucleophilic reagents or heat during development step.

Examples of the reducing agent and precursor are described in the following patents.

| | | |
|---|---|---|
| U.S. Pat. Nos. 4,500,626 | 4,483,914 | 4,330,617 |
| 4,950,152 | | |
| JP-A 140335/1985 | 40245/1982 | 138736/1981 |

-continued

| | | |
|---|---|---|
| 178458/1984 | 53831/1984 | 182449/1984 |
| 182450/1984 | 119555/1985 | 128436/1985 |
| 128437/1985 | 128438/1985 | 128439/1985 |
| 198540/1985 | 181742/1985 | 259253/1986 |
| 244044/1987 | 131253/1987 | 131254/1987 |
| 131255/1987 | 131256/1987 | |
| EP-A 220746 A2 | | |

Also useful are combinations of reducing agents as disclosed in U.S. Pat. No. 3,039,869.

Where a non-diffusion reducing agent is used, an electron transfer agent and/or a precursor thereof may be used for promoting electron transfer between the non-diffusion reducing agent and developable silver halide, if desired. The electron transfer agents and precursors thereof may be selected from the above-mentioned reducing agents and precursors thereof. The electron transfer agent or precursors thereof should preferably have greater mobility than the non-diffusion reducing agent (electron donor). Useful electron transfer agents are 1-phenyl-3-pyrazolidones and aminophenols.

The non-diffusion reducing agent (electron donor) which is combined with the electron transfer agent may be selected from those of the above-mentioned reducing agents which are substantially immobile in a layer of photosensitive material, for example, hydroquinones, sulfonamidophenols, sulfonamidonaphthols, as well as the electron donors described in JP-A 110827/1978 and dye-providing substances having non-diffusible and reducing properties to be described later.

In the photosensitive material according to the present invention, the reducing agent is generally added in an amount of 0.001 to 20 mol, preferably 0.01 to 10 mol per mol of silver.

In the present invention, the photosensitive material may contain an image forming substance in the form of a compound which, when silver ion is reduced into silver at elevated temperatures, produces or releases a mobile or diffusible dye in direct or inverse proportion to the reaction. These compounds are simply referred to as dye-providing substances hereinafter.

Typical of the dye-providing substances which can be used herein are compounds capable of forming a dye through oxidative coupling reaction, that is, couplers. The couplers may be four- or two-equivalent couplers. Also useful is a two-equivalent coupler which has a non-diffusible group as a coupling-off group so that it forms a diffusible dye through oxidative coupling reaction. The non-diffusible group may take the form of a polymer. Illustrative examples of the color developing agents and couplers are described in detail in, for example, T. H. James, "The Theory of the Photographic Process", 4th Ed., pages 291–334 and 354–361, as well as the following JP-A's.

| | | |
|---|---|---|
| 123533/1983 | 149046/1983 | 149047/1983 |
| 111148/1984 | 124399/1984 | 174835/1984 |
| 231539/1984 | 231540/1984 | 2950/1985 |
| 2951/1985 | 14242/1985 | 23474/1985 |
| 66249/1985 | | |

Another example of the dye-providing substance is a compound having the function of releasing or diffusing a diffusible dye imagewise. The compounds of this type may be represented by the following formula [L I]:

$(Dye—Y)_n—Z$ [L I]

wherein dye represents a dye group, a temporary short-waved dye group, or a dye precursor group; Y represents a valence bond or a bridging linkage; and Z represents a group which, in correspondence or counter-correspondence to photosensitive silver salt having a latent image distributed imagewise, produces a difference in diffusibility of the compound represented by $(Dye-Y)_n—Z$ or releases Dye, the diffusibility of Dye released being different from that of the compound represented by $(Dye-Y)_n—Z$, and n represents an integer of 1 or 2. When n=2, the Dye-Y's may be the same or different.

Typically included in the dye-providing compounds of formula [L I] are the following five classes (1) to (5) of compounds. The compounds of classes (1) to (3) are those which produce mobile dye images or positive dye images in counter proportion to the development of silver halide, that is, positive dye-providing compounds whereas the compounds of classes (4) to (5) are those which produce mobile dye images or negative dye images in proportion to the development of silver halide, that is, negative dye-providing compounds.

Class (1) consists of dye developing agents in the form of a hydroquinone-type developing agent having a dye moiety attached thereto as disclosed in U.S. Pat. No. 3,134,764; 3,362,819; 3,597,200; 3,544,545 and 3,482,972. The dye developing agents are diffusible under alkaline conditions, but become non-diffusible upon reaction with silver halide.

Class (2) consists of non-diffusible compounds which release mobile or diffusible dyes under alkaline conditions, but lose that ability and become non-diffusible upon reaction with silver halide. Exemplary are the compounds which release diffusible dyes through intramolecular nucleophilic substitution reaction as disclosed in U.S. Pat. No. 3,980,479 and the compounds which release diffusible dyes through intramolecular rewind reaction of an isooxazolone ring as disclosed in U.S. Pat. No. 4,199,354.

Class (3) consists of non-diffusible compounds which react with the remainder of a reducing agent which is left without being consumed or oxidized in development, to release diffusible dyes as described in U.S. Pat. No. 4,559,290 and 4,783,396, EP 220,746 A2, and Technical Report 87-6199. Exemplary are the compounds which release diffusible dyes through reduction and subsequent intramolecular nucleophilic substitution reaction as disclosed in U.S. Pat. No. 4,139,389 and 4,139,379 and JP-A 185333/1984 and 84453/1982; the compounds which release diffusible dyes through reduction and subsequent intramolecular electron transfer reaction as disclosed in U.S. Pat. No. 4,232,107, JP-A 101649/1984 and 88257/1986, and RD 24025 (1984); the compounds which release diffusible dyes through reduction and subsequent cleavage of a single bond as disclosed in German Patent No. 3,008,588 A, JP-A 142530/1981, U.S. Pat. No. 4,343,893 and 4,619,884; the nitro compounds which release diffusible dyes upon receipt of electrons as disclosed in U.S. Pat. No. 4,450,223; and the compounds which release diffusible dyes upon receipt of electrons as disclosed in U.S. Pat. No. 4,609,610.

Preferred examples are the compounds having a N—X bond wherein X is an oxygen, sulfur or nitrogen atom and an electron attractive group in a molecule as disclosed in EP 220,746 A2, Technical Report No. 87-6199, U.S. Pat. No. 4,783,396, JP-A 201653/1988 and 201654/1988; the compounds having a $SO_2$—X bond wherein X is as defined above and an electron attractive group in a molecule as disclosed in JP-A 26842/1989; the compounds having a PO—X bond wherein X is as defined above and an electron attractive group in a molecule as disclosed in JP-A 271344/1988; the compounds having a C—X' bond wherein X' is the same as X defined above or —$SO_2$— and an electron attractive group in a molecule as disclosed in JP-A 271341/1988; and the compounds which release diffusible dyes through reduction and subsequent cleavage of a single bond triggered by a $\pi$-bond conjugated with an electron accepting group as disclosed in JP-A 161237/1989 and 161342/1989. More preferred among these are the compounds having a N—X bond and an electron attractive group in a molecule, with preferred ones being identified as compounds (1)–(3), (7)–(10), (12), (13), (15), (23)–(26), (31), (32), (35), (36), (40), (41), (44), (53)–(59), (64), and (70) described in EP 220,746 A2 or U.S. Pat. No. 4,783,396 and compounds (11) to (23) in Technical Report No. 87-6199.

Class (4) consists of couplers which have a diffusible dye as an eliminatable group and thus release a diffusible dye through reaction with an oxidant of a reducing agent, known as DDR couplers, as described in British Patent No. 1,330,524, JP-B 39165/1973; U.S. Pat. No. 3,443,940, 4,474,867 and 4,483,914.

Class (5) consists of compounds (DRR couplers) which themselves have reducing nature to silver halide or organic silver salts and release a diffusible dye upon reduction of the silver halide or organic silver salts. Eliminating a need for an extra reducing agent, the DRR couplers overcome the serious problem that an image can be contaminated with oxidation decomposition products of a reducing agent. Typical examples are described in the following patents.

| | | |
|---|---|---|
| U.S. Pat. Nos. 3,443,939 | 3,725,062 | 3,728,113 |
| 3,928,312 | 4,053,312 | 4,055,428 |
| 4,336,322 | 4,500,626 | |
| JP-A 65839/1984 | 69839/1984 | 116537/1983 |
| 179840/1982 | 3819/1978 | 104343/1976 |

and RD 17465. Examples of the DRR compound are described in U.S. Pat. No. 4,500,626, columns 22–44, with preferred ones being identified as compounds (1)–(3), (10)–(13), (16)–(19), (28)–(30), (33)–(35), (38)–(40), and (42)–(64). Also useful are those described in U.S. Pat. No. 4,639,408, columns 37–39.

There are available dye-providing compounds other than the aforementioned couplers and compounds of formula [L I]. Such additional dye-providing compounds include dye-silver compounds in which an organic silver salt is combined with a dye (see Research Disclosure, May 1978, pages 54–58); azo dyes useful in heat development silver dye bleaching process (see U.S. Pat. No. 4,235,957 and Research Disclosure, April 1976, pages 30–32); and leuco dyes (see U.S. Pat. No. 3,985,565 and 4,022,617).

The dye-providing compounds may be introduced in an emulsion layer or a non-photosensitive layer adjacent thereto or both an emulsion layer and a non-photosensitive layer adjacent thereto.

Hydrophobic additives like dye-providing compounds and non-diffusible reducing agents may be introduced into a layer of photosensitive material by any desired method, for example, by the method described in U.S. Pat. No. 2,322,027. Use may be made of high-boiling organic solvents as described in JP-A 83154/1984, 178451/1984, 178452/1984, 178453/1984, 178454/1984, 178455/1984, 178457/1984, optionally in combination with low-boiling organic solvents having a boiling point of 50° to 160° C. The amount of the high-boiling organic solvent used is generally up to 10 grams, preferably up to 5 grams per gram of the dye-providing compound and up to 1 cc, preferably up to 0.5 cc, more preferably up to 0.3 cc per gram of the binder. A dispersion method using a polymer as disclosed in JP-B 39853/1976 and JP-A 59943/1976 may be used. In the case of substantially water-insoluble compounds, they may be dispersed in a binder as fine particles although any of the aforementioned addition methods may be used.

In dispersing hydrophobic compounds in hydrophilic colloids, a variety of surfactants may be used. Examples are found in JP-A 157636/1984, pages 37–38.

The photosensitive material according to the invention may further contain a compound capable of activating development and stabilizing an image at the same time. Examples are found in U.S. Pat. No. 4,500,626, columns 51–52.

In the system of forming images through diffusion transfer of dyes, a photosensitive material is used in combination with a dye fixing element. There are generally two typical forms, one form having photosensitive material and dye-fixing element separately applied on two separate supports and another form having both photosensitive material and dye-fixing element applied on a common support. With respect to the relation of the photosensitive material and the dye-fixing element to one another, to the support, and to a white reflective layer, reference may be made to U.S. Pat. No. 4,500,626, col. 57.

The dye-fixing element preferably used in the present invention has at least one layer containing a mordant and a binder. The mordant may be selected from those known in the photographic art, for example, the mordants described in U.S. Pat. No. 4,500,626, col. 58–59 and JP-A 88256/1986, pages 32–41; and the compounds described in JP-A 244043/1987 and 244036/1987. Also useful are dye accepting polymers as disclosed in U.S. Pat. No. 4,463,079. If desired, the dye-fixing element may be provided with any auxiliary layer, for example, a protective layer, peeling layer, and anti-curling layer, in addition to the above-mentioned layers. Provision of a protective layer is especially effective.

The photosensitive material and dye-fixing element include layers which may contain a plasticizer, lubricant, or high-boiling organic solvent serving as an agent for facilitating stripping of the photosensitive material from the dye-fixing element. Examples are found in JP-A 53159/1987 and 245253/1987.

Moreover, various silicone fluids may be used for the same purpose as above. The silicone fluids include dimethylsilicone fluid and modified silicone fluids of dimethylsiloxane having organic groups incorporated therein. Examples are the modified silicone fluids described in "Modified Silicone Oil Technical Data", Shin-Etsu Silicone K.K., pages 16–18B, especially carboxy-modified silicone (trade name X-22-3710). Also useful are the silicone fluids described in JP-A 215953/1987 and 46449/1988.

Various anti-fading agents may be used in the photosensitive material and dye-fixing element according to the invention. Antioxidants, UV absorbers and metal complexes are included in the anti-fading agents. Examples of the antioxidants include chromans, coumarans, phenols (e.g., hindered phenols), hydroquinone derivatives, hindered amine derivatives, and spiro-indanes. Also useful are the compounds described in JP-A 159644/1986. Examples of the UV absorber include benzotriazoles as described in U.S. Pat. No. 3,533,794, 4-thiazolidones as described in U.S. Pat. No. 3,352,681, benzophenones as described in JP-A 2784/1971, and other compounds as described in JP-A 48535/1979, 136641/1987, 88256/1986, etc. UV absorbing polymers as described in JP-A 260152/1987 are also useful. Examples of the metal complex are described in U.S. Pat. No. 4,241,155, 4,245,018, col. 3–36, and 4,254,195, col. 3–8, JP-A 174741/1987, 88256/1986, pages 27–29, 199248/1988, 75568/1989 and 74272/1989. Useful examples of the anti-fading agent are described in JP-A 215272/1987, pages 125–137.

For preventing color fading of the dye transferred to a dye-fixing element, the anti-fading agent may be previously incorporated in the dye-fixing element or subsequently supplied to the dye-fixing element from the exterior such as the photosensitive material. The antioxidants, UV absorbers and metal complexes may be used alone or in combination of two or more.

Fluorescent brighteners may be used in the photosensitive material and dye-fixing element according to the present invention. Preferably, the brightener is incorporated in the dye-fixing element or supplied thereto from the exterior such as the photosensitive material. Exemplary brighteners are described in K. Veenkataraman, "The Chemistry of Synthetic Dyes", Vol. V, Chap. 8, and JP-A 143752/1986. Illustrative examples include stilbene compounds, coumarin compounds, biphenyl compounds, benzoxazolyl compounds, naphthalimide compounds, pyrazoline compounds, and carbostyryl compounds. The brightener may be combined with the anti-fading agent.

The photosensitive material and dye-fixing element according to the present invention may contain a hardener in a photographic emulsion layer or another layer. Useful hardeners are described in U.S. Pat. No. 4,678,739, JP-A 116655/1984, 245261/1987, and 18942/1986. Illustrative examples include aldehyde hardeners (e.g., formaldehyde), aziridine hardeners, epoxy hardeners, vinylsulfon hardeners (e.g., N,N'-ethylene-bis(vinylsulfonylacetamide)ethane), N-methylol hardeners (e.g., dimethylol urea), and polymeric hardeners (e.g., the compounds described in JP-A 234157/1987).

The photosensitive material and dye-fixing element may contain a surfactant in any layer thereof for various purposes including coating aid, stripping aid, lubrication, antistatic, and development acceleration. Useful surfactants are found in JP-A 173463/1987 and 183457/1987.

The photosensitive material and dye-fixing element may contain an organic fluorine compound in any layer thereof for various purposes including lubrication, antistatic, and stripping aid. Useful organic fluorine compounds are the fluoride surfactants described in JP-A 9053/1982, 20944/1986 and 135826/1987, and hydrophobic fluorine compounds including oily fluorine compounds such as fluoro-oil and solid fluorine compound resins such as tetrafluoroethylene resin.

The photosensitive material and dye-fixing element may contain a matte agent in any layer thereof. Exemplary matte agents include silicon dioxide, polyolefins, polymethacrylate and other compounds as described in JP-A 88256/1986, and beads of benzoguanamine resin, polycarbonate resin, AS resin or the like as described in JP-A 274944/1988 and 274952/1988.

The photosensitive material and dye-fixing element may contain thermal solvents, defoaming agents, antifungal and antibacterial agents, colloidal silica or the like in any layer thereof. These additives are described in JP-A 88256/1986, pages 26–32.

Image formation promoters may also be used in the photosensitive material and/or dye-fixing material in the practice of the present invention. The image formation promoters have the functions of promoting such reactions as redox reaction of a silver salt-oxidizing agent with a reducing agent, formation of a dye from a dye-providing substance, decomposition of a dye or release of a mobile dye, and promoting transfer of a dye from a photosensitive material layer to a dye-fixing layer. From their physical-chemistry, they may be classified into bases, base precursors, nucleophilic compounds, high-boiling organic solvents (oils), thermal solvents, surfactants, and compounds capable of interacting with silver or silver ion. It should be noted that these compounds generally have multiple functions and thus possess some of the above-mentioned promoting effects combined. For further detail, reference is to be made to U.S. Pat. No. 4,678,739, col. 38–40.

Base precursors are preferably those precursors which undergo any reaction under heat to release a base, for example, organic acid-base salts which are decomposed or decarbonated upon heating, and compounds which are decomposed to release amines through intramolecular nucleophilic substituting reaction, Lossen rearrangement or Beckman rearrangement. Examples are found in U.S. Pat. No. 4,511,493 and JP-A 65038/1987.

In a system wherein heat development and dye transfer are simultaneously carried out in the presence of a minor amount of water, the base and/or base precursor may be contained in the dye-fixing element because the photosensitive material is improved in shelf stability.

Additionally, combinations of a difficultly soluble metal compound and a compound capable of reaction with a metal ion of said difficultly soluble metal compound to form a complex (complexing compound) as described in EP-A 210,660 and U.S. Pat. No. 4,740,445 and compounds which generate bases through electrolysis as described in JP-A 232451/1986 may also be used as the base precursor. The former is particularly effective. Advantageously, the difficultly soluble metal compound and complexing compound are separately added to the photosensitive material and dye-fixing element.

The photosensitive material and/or dye-fixing element may contain a development stopper for the purpose of providing consistent images at all times despite of variations in temperature and time of development. The development stopper used herein is a compound which quickly neutralizes a base or reacts with a base to reduce the base concentration in the film for terminating development or a compound which interacts with silver or a silver salt for suppressing development, both after optimum development has been done. Useful are acid precursors which release acids upon heating, electrophilic compounds which undergo substitution reaction with coexisting bases upon heating, nitrogenous heterocyclic compounds, mercapto compounds and precursors thereof. For detail, reference is made to JP-A 253159/1987.

The support used in the heat-developable photosensitive material and dye-fixing material according to the present invention may be of any desired material which can withstand the processing temperature. Typical supports are those of paper and synthetic polymers (film). Examples include films of polyethylene terephthalate (PET), polycarbonate, polyvinyl chloride, polystyrene, polypropylene, polyimide, and celluloses (e.g., triacetyl cellulose), those films having incorporated therein pigments such as titanium oxide, synthetic paper formed from polypropylene or the like, mix paper machined from synthetic resin pulp such as polyethylene and natural pulp, Yankee paper, baryta paper, coated paper (cast coated paper), metals, fabrics, and glass. These supports may be used alone or supports laminated with synthetic polymers such as polyethylene on one or both surfaces thereof be used. Also useful are the supports described in JP-A 253159/1987, pages 29–31.

The support on the surface may be coated with a hydrophilic binder and an antistatic agent such as a semiconductor metal oxide (e.g., alumina sol and tin oxide) and carbon black.

For exposing the photosensitive material imagewise to record images therein, a variety of exposure methods are employable. For example, exposure may be done by actuating a light emitting diode, laser or the like to emit light for exposure in response to electrical signals representative of image information;

A variety of light sources may be used for recording images in photosensitive material, for example, light emitting diodes, laser light sources and the like as described in U.S. Pat. No. 4,500,625, col. 56.

Also acceptable is imagewise exposure using a wavelength conversion element having a non-linear optical material combined with a coherent light source such as a laser. The non-linear optical material used herein is that material which when an intense photoelectric field as provided by laser light is applied, can develop polarization in non-linear relationship with the electric field. Examples include inorganic compounds such as lithium niobate, potassium dihydrogen phosphate (KDP), lithium iodate and $BaB_2O_4$; urea derivatives and nitroaniline derivatives, for example, nitropyridine-N-oxide derivatives such as 3-methyl-4-nitropyridine-N-oxide (POM); and the compounds described in JP-A 53462/1986 and 210432/1987. The wavelength conversion elements include single crystal optical waveguide and fiber types which are both applicable.

The image information may be given in the form of image signals available from video cameras and electronic still cameras, television signals as represented by NTSC, image signals obtained by dividing an original into a multiplicity of pixels by means of a scanner, and image signals created by means of computers as represented by CG and CAD.

The photosensitive material and/or dye-fixing element may have a conductive heater layer as means for producing heat necessary for heat development or dye diffusion transfer. Transparent or non-transparent heater elements as described in JP-A 145544/1986 may be used. These conductive layers also serve as antistatic layers.

In heat developing the heat-developable color photosensitive material according to the invention, the heating temperature is about 50° C. to about 250° C., preferably about 80° C. to about 180° C. Dye diffusion transfer may be effected at the same time as heat development or after the completion of heat development. In the latter case, the heating temperature in the transfer step may be from room temperature to the temperature used in the heat development, preferably from about 50° C. to a temperature about 10° C. lower than the heat development temperature.

Dye transfer can be induced solely by heat although a solvent may be used for promoting dye transfer. It is also useful to heat in the presence of a minor amount of solvent (especially water) to carry out development and transfer simultaneously or sequentially as disclosed in JP-A 218443/1984 and 238056/1986. In this mode, the heating temperature is from 50° C. to below the boiling point of the solvent, for example, from 50° C. to 100° C. if the solvent is water.

Examples of the solvent which is used in order to promote development and/or allow the diffusible dye to migrate to the dye-fixing layer include water and basic aqueous solutions containing inorganic alkali metal salts and organic bases (which may be those previously described for the image formation promoter). Also, low-boiling solvents and mixtures of a low-boiling solvent and water or a basic aqueous solution are useful. Surfactants, anti-foggants, difficultly soluble metal salts and complexing compounds or the like may be contained in the solvents.

The solvent is used by applying it to the dye-fixing material or photosensitive material or both. The amount of the solvent used may be as small as below the weight of solvent corresponding to the maximum swollen volume of entire coatings, especially below the weight of solvent corresponding to the maximum swollen volume of entire coatings minus the dry weight of entire coatings.

Useful for applying the solvent to the photosensitive layer or dye-fixing layer is a method as disclosed in JP-A 147244/1986, page 26. It is also possible to seal the solvent in microcapsules and incorporate the microcapsules in the photosensitive material or dye-fixing material or both.

To promote dye transfer, a hydrophilic thermal solvent which is solid at room temperature, but soluble at high temperature may be incorporated into the photosensitive material or dye-fixing material or both. The layer into which the thermal solvent is incorporated is not limited and may be selected from emulsion layers, intermediate layer, protective layer and dye-fixing layer. Preferably, the thermal solvent is incorporated into the dye-fixing layer and/or layers contiguous thereto. Examples of the hydrophilic thermal solvent include ureas, pyridines, amides, sulfonamides, imides, alcohols, oximes, and heterocyclics. To promote dye transfer, a high-boiling organic solvent may be incorporated into the photosensitive material or dye-fixing material or both.

Heating required in the development and/or transfer step may be carried out by any desired means, for example, by contacting with heated blocks or plates, contacting with hot plates, hot presses, hot rollers, halide lamp heaters, infrared or far infrared lamp heaters, or by passing through a hot atmosphere.

Pressure is applied in overlapping a photosensitive element and a dye-fixing element in close contact. Such pressure requirements and pressure application are described in JP-A 147244/1986, page 27.

For processing photographic elements according to the present invention, there may be used any of various developing apparatus including those described in JP-A 75247/1984, 177547/1984, 181353/1984 and 18951/1985 and Japanese U.M. Application Kokai No. 25944/1987.

EXAMPLE

Examples of the present invention are given below by way of illustration and not by way of limitation.

The following example demonstrates a heat-developable color photosensitive material according to the present invention.

Preparation of Emulsion (1)

To a thoroughly agitated aqueous gelatin solution of the composition shown in Table 1, Solutions I and II of the compositions shown in Table 2 were added over 18 minutes. After 5 minutes from the completion of addition of Solutions I and II, Solutions III and IV of the compositions shown in Table 2 were added over 42 minutes. After desalting with a flocculant (P-1) (identified earlier in this disclosure) and water washing (pH 4.1), 22 grams of gelatin was added to the solution which was adjusted with an aqueous solution of NaCl and NaOH to pH 6.1 and pAg 7.6 (as measured at 40° C.) for redispersion. The dispersion was then chemically sensitized optimum at 60° C. using triethylthiourea and 4-hydroxy-6-methyl-(1,3,3a,7)-tetraazaindene. The optimum chemical sensitization means that a maximum sensitivity is achieved without incurring fog. A monodispersed emulsion of cubic grains having a mean particle size of 0.26 μm and a coefficient of variation of 8.5% was obtained in a yield of 635 grams.

TABLE 1

| | |
|---|---|
| $H_2O$ | 620 cc |
| Gelatin | 20 g |
| KBr | 0.03 g |
| NaCl | 2.00 g |
| $H_2SO_4$ (1N) | 16 cc |
| Compound A* | 0.015 g |
| pH | 3.9 |
| Temperature | 46° C. |

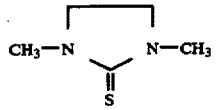

TABLE 2

| | Solution | | | |
|---|---|---|---|---|
| | I | II | III | IV |
| $AgNO_3$ | 30.0 g | — | 70.0 g | — |
| KBr | — | 13.7 g | — | 44.1 g |
| NaCl | — | 3.6 g | — | 2.4 g |
| $K_2IrCl_6$ | — | — | — | $4.0 \times 10^{-5}$ g |
| Water totaling to | 150 cc | 150 cc | 350 cc | 350 cc |

Preparation of Emulsion (2)

Emulsion (2) was prepared by the same procedure as Emulsion (1) except that chemical sensitization was effected at 70° C., sensitizing dye D-18 (identified earlier in this disclosure) was added after the addition of triethylthiourea and 4-hydroxy-6-methyl-(1,3,3a,7)-tetraazaindene and the dispersion was then agitated for 30 minutes.

Preparation of Emulsion (3)

Emulsion (3) was prepared by the same procedure as Emulsion (1) except that 80 ml of a methanol solution containing 0.5% of sensitizing dye (1) identified below was added all at once at the end of addition of Solutions I and II, a flocculant (P-2) (identified earlier in this disclosure) was used, and the sulfur sensitizer was changed from the triethylthiourea to sodium thiosulfate. A monodispersed emulsion of nearly rectangular, somewhat distorted cubic grains having a mean particle size of 0.31 μm and a coefficient of variation of 10.2% was obtained in a yield of 635 grams.

Gelatin dispersions of dye-providing substances were prepared as follows.

To 70 ml of ethyl acetate were added 14.64 grams of a magenta dye-providing substance (A), 0.21 grams of a reducing agent (1), 0.20 grams of a mercapto compound (1), 0.38 grams of a surfactant (3), and 5.1 grams of a high-boiling organic solvent (2). The mixture was heated to about 60° C. to form a uniform solution. This solution was mixed with 100 grams of 10% lime-treated gelatin solution and 60 ml of water. The mixture was subjected to dispersion by a homogenizer at 10,000 rpm for 10 minutes. This dispersion is designated a magenta dye-providing substance dispersion.

To 50 ml of ethyl acetate were added 7.3 grams of a cyan dye-providing substance (B1), 10.6 grams of a cyan dye-providing substance (B2), 1.0 grams of a reducing agent (1), 0.3 grams of a mercapto compound (1), 0.095 grams of a surfactant (1), and 9.8 grams of a high-boiling organic solvent (1). The mixture was heated to about 60° C. to form a uniform solution. This solution was mixed with 100 grams of 10% lime-treated gelatin solution and 60 ml of water. The mixture was subjected to dispersion by a homogenizer at 10,000 rpm for 10 minutes. This dispersion is designated a cyan dye-providing substance dispersion.

To 45 ml of ethyl acetate were added 18.75 grams of a yellow dye-providing substance (C), 1.0 grams of a reducing agent (1), 0.12 grams of a mercapto compound (1), 1.5 grams of a surfactant (3), 7.5 grams of a high-boiling organic solvent (1), and 2.1 grams of a dyestuff (F). The mixture was heated to about 60° C. to form a uniform solution. This solution was mixed with 100 grams of 10% lime-treated gelatin solution and 60 ml of water. The mixture was subjected to dispersion by a homogenizer at 10,000 rpm for 10 minutes. This dispersion is designated a yellow dye-providing substance dispersion.

Using these and other materials, a heat-developable color photosensitive material No. 100 (control) of the multilayer structure formulated in Table 3 was fabricated. For the emulsion layer forming the first layer, the sensitizing dye was added during preparation of an emulsion coating composition. For the emulsion layer forming the third layer, the sensitizing dye was added during chemical sensitization. For the emulsion layer forming the fifth layer, the sensitizing dye was added during grain formation. These sensitizing dyes were added in optimum amount to ensure maximum sensitivity.

TABLE 3

| Photosensitive material No. 100 | |
|---|---|
| Additives | Coating weight (g/m$^2$) |
| 7th layer: protective layer | |
| Gelatin | 0.264 |
| Matte agent | 0.018 |
| Zn(OH) | 0.964 |
| Surfactant (1) | 0.028 |
| Surfactant (2) | 0.011 |
| Water-soluble polymer (1) | 0.004 |
| 6th layer: intermediate layer | |
| Gelatin | 0.762 |
| Surfactant (1) | 0.007 |
| Surfactant (2) | 0.022 |
| Water-soluble polymer (1) | 0.016 |
| 5th layer: red (670 nm) sensitive layer | |
| Emulsion (3) | 0.321 of Ag |
| 4-hydroxy-6-methyl-1,3,3a,7-tetraazaindene | 0.00193 |
| Sensitizing dye (1) | 0.0013 |
| Magenta dye-providing substance (A) | 0.2845 |
| High-boiling organic solvent (2) | 0.100 |
| Reducing agent | 0.004 |
| Mercapto compound (1) | 0.004 |
| Surfactant (3) | 0.007 |
| Gelatin | 0.297 |
| Antifoggant (1) | 0.003 |
| Water-soluble polymer (1) | 0.007 |
| Mercapto compound (3) | 0.00044 |
| 4th layer: intermediate layer | |
| Hardener | 0.058 |
| Gelatin | 0.629 |
| Surfactant (1) | 0.009 |
| Surfactant (4) | 0.046 |
| Water-soluble polymer (1) | 0.012 |
| 3rd layer: near infrared (750 nm) sensitive layer | |
| Emulsion (2) | 0.320 of Ag |
| 4-hydroxy-6-methyl-1,3,3a,7-tetraazaindene | 0.00352 |
| Sensitizing dye D-18 | $8.5 \times 10^{-4}$ |
| Cyan dye-providing substance (B1) | 0.132 |
| Cyan dye-providing substance (B2) | 0.193 |
| High-boiling organic solvent (1) | 0.178 |
| Reducing agent (1) | 0.018 |
| Mercapto compound (1) | 0.005 |
| Surfactant (1) | 0.0035 |
| Gelatin | 0.284 |
| Mercapto compound (3) | 0.003 |
| Stabilizer (1) | 0.0086 |
| Water-soluble polymer (1) | 0.010 |
| 2nd layer: intermediate layer | |
| Gelatin | 0.629 |
| Surfactant (1) | 0.006 |
| Surfactant (4) | 0.057 |
| Water-soluble polymer (1) | 0.009 |
| 1st layer: infrared (810 nm) sensitive layer | |
| Emulsion (1) | 0.340 of Ag |
| 4-hydroxy-6-methyl-1,3,3a,7-tetraazaindene | 0.00153 |
| Mercapto compound (2) | $8.4 \times 10^{-4}$ |
| Sensitizing dye D-33 | $1.1 \times 10^{-4}$ |
| Yellow dye-providing substance (C) | 0.429 |
| Dyestuff (F) | 0.049 |
| High-boiling organic solvent (1) | 0.172 |
| Reducing agent (1) | 0.023 |
| Mercapto compound (1) | 0.003 |
| Surfactant (3) | 0.034 |
| Gelatin | 0.338 |
| Stabilizer (1) | 0.0054 |
| Water-soluble polymer (1) | 0.014 |
| Support: | |
| Polyethylene-laminated neutral paper (120 μm thick) | |

The components in Table 3 have the structural formulae shown below.

Magenta dye-providing substance (A):

-continued
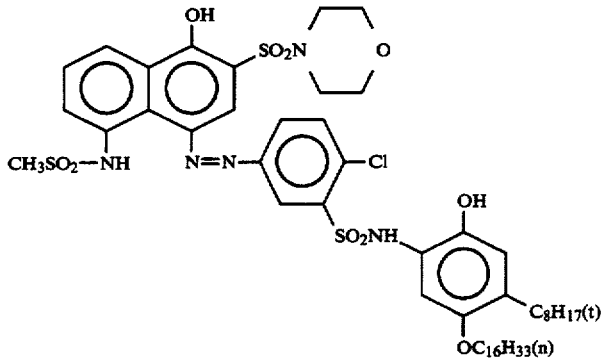
Cyan dye-providing substance (B1):
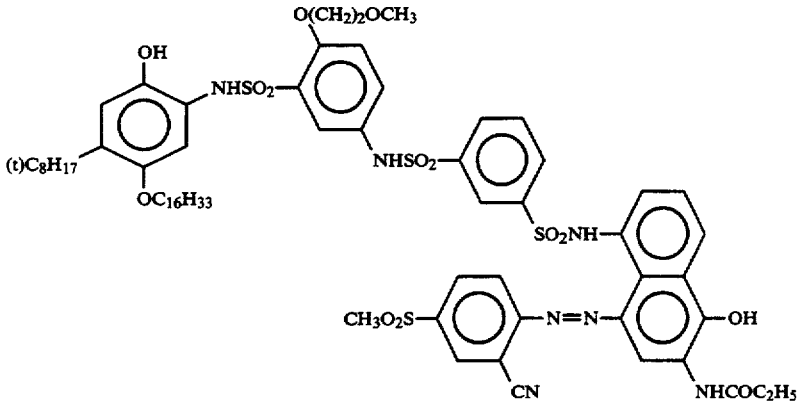
Cyan dye-providing substance (B2):
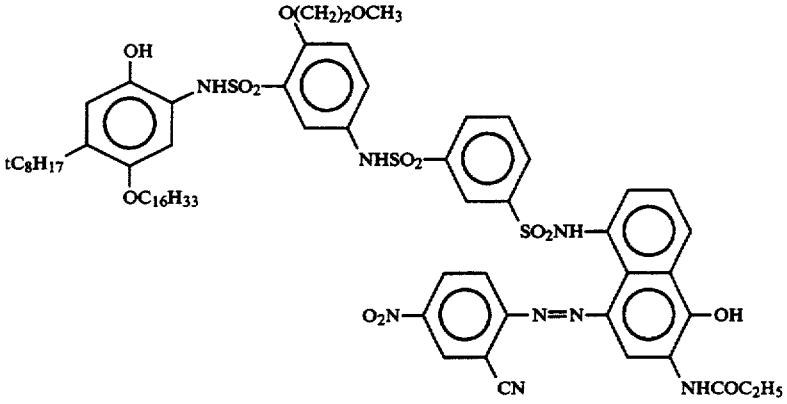
Yellow dye-providing substance (C):
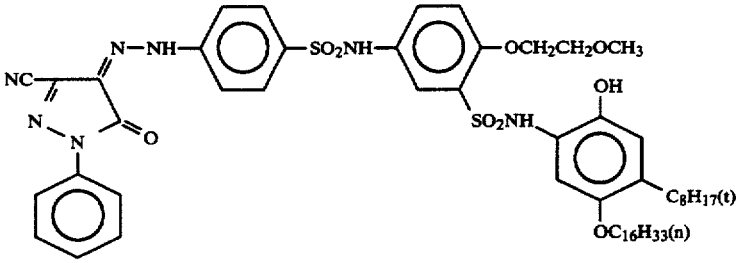
Reducing agent (1):
Mercapto compound (1):

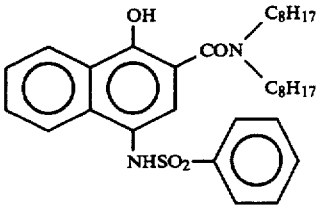

Surfactant (1):
Aerosol OT

-continued

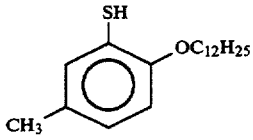

Surfactant (2):

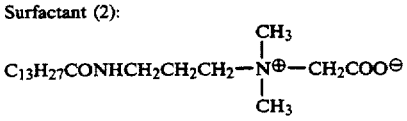

Surfactant (3):

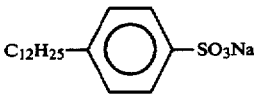

Surfactant (4):

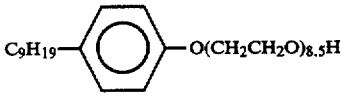

Dyestuff (F)

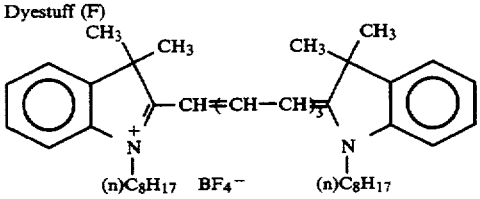

Mercapto compound (2):

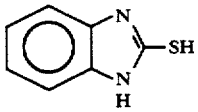

Mercapto compound (3):

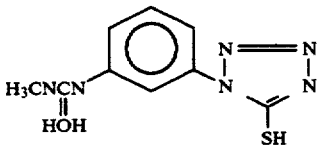

Hardener:
$CH_2{=}CHSO_2CH_2CONH(CH_2)_2NHCOCH_2SO_2CH{=}CH_2$

Stabilizer (1):

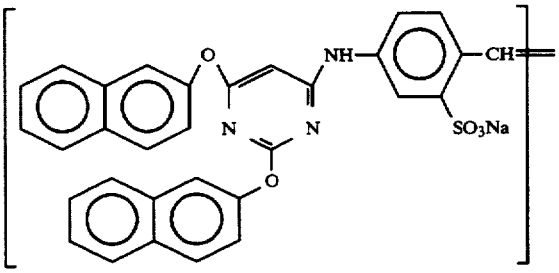

Sensitizing dye (1):

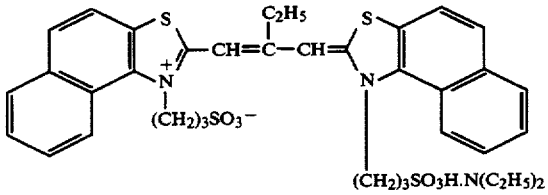

Water-soluble polymer (1):

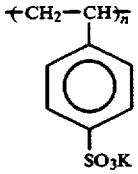

High-boiling solvent (1):
triisonoyl phosphate

High-boiling solvent (2):
tricyclohexyl phosphate

Antifoggant:
benzotriazole.

Preparation of photosensitive materials within the scope of the invention

Photosensitive material No. 101 was fabricated by the same procedure as photosensitive material No. 100 except that in the preparation of the emulsion for the third layer, 25 ml of an aqueous 1% KI solution was added 9 minutes later from the start of addition of Solutions I and II. The amount of iodine added was 0.24 mol % based on the silver halide.

Photosensitive material No. 102 was fabricated by the same procedure as No. 100 except that in the preparation of the emulsion for the third layer, 25 ml of an aqueous 1% KI solution was added 2 minutes later from the end of addition of Solutions I and II.

Photosensitive material No. 103 was fabricated by the same procedure as No. 100 except that in the preparation of the emulsion for the third layer, 25 ml of an aqueous 1% KI solution was added 21 minutes later from the start of addition of Solutions III and IV.

Photosensitive material No. 104 was fabricated by the same procedure as No. 100 except that in the preparation of the emulsion for the third layer, 25 ml of an aqueous 1% KI solution was added 31½ minutes later from the start of addition of Solutions III and IV.

Photosensitive material No. 105 was fabricated by the same procedure as No. 100 except that in the preparation of the emulsion for the third layer, 25 ml of an aqueous 1% KI solution was added 1 minute before the end of addition of Solutions III and IV.

Photosensitive material No. 106 was fabricated by the same procedure as No. 100 except that in the preparation of the emulsion for the third layer, 25 ml of an aqueous 1% KI solution was added 1 minute later from the end of addition of Solutions III and IV.

Photosensitive material No. 107 was fabricated by the same procedure as No. 100 except that in the preparation of the emulsion for the third layer, an aqueous 1% KI solution was added 5 minutes before the addition of the sensitizing dye in an amount of 0.04 mol % of iodine based on the silver halide grains.

Photosensitive material No. 108 was fabricated by the same procedure as No. 100 except that in the preparation of the emulsion for the third layer, an aqueous 1% KI solution was added 5 minutes before the addition of the sensitizing dye in an amount of 0.25 mol % based on the silver halide grains.

Photosensitive material No. 109 was fabricated by the same procedure as No. 100 except that in the preparation of the emulsion for the third layer, KI was added to the sensitizing dye solution in an amount of 0.04 mol % based on the silver halide grains.

Photosensitive material No. 110 was fabricated by the same procedure as No. 100 except that in the preparation of the emulsion for the third layer, an aqueous 1% KI solution was added 5 minutes later from the addition of the sensitizing dye in an amount of 0.04 mol % based on the silver halide grains.

Photosensitive material No. 111 was fabricated by the same procedure as No. 100 except that in the preparation of the emulsion for the third layer, an aqueous 1% KI solution was added during preparation of an emulsion coating composition in an amount of 0.04 mol % based on the silver halide grains.

Photosensitive material No. 112 was fabricated by the same procedure as No. 100 except that in the preparation of the emulsion for the third layer, 25 ml of an aqueous 1% KI solution was added 1 minute later from the end of addition of Solutions III and IV, the temperature raised to 70° C., the sensitizing dye added, agitation continued for 30 minutes, and the dye during chemical sensitization was omitted.

Photosensitive material No. 113 was fabricated by the same procedure as No. 106 except that in the preparation of the emulsion for the third layer, $K_2IrCl_6$ was removed from Solution IV.

For comparison purposes, photosensitive material No. 114 was fabricated by the same procedure as No. 100 except that in the preparation of the emulsion for the third layer, 25 ml of an aqueous 1% KI solution was initially added to the aqueous gelatin solution.

Preparation of emulsion (4) outside the scope of the invention

To a thoroughly agitated aqueous gelatin solution of the composition shown in Table 4, Solutions I and II of the compositions shown in Table 5 were added over 36 minutes. After 5 minutes from the completion of addition of Solutions I and II, Solutions III and IV of the compositions shown in Table 5 were added over 42 minutes while maintaining a silver potential of −30 mV versus SCE. After desalting with a flocculant (P-1) and water washing (pH 4.1), 22 grams of gelatin was added to the solution which was adjusted with an aqueous solution of KBr and NaOH to pH 6.1 and pAg 7.6 (as measured at 40° C.) for re-dispersion. The dispersion was then chemically sensitized at 70° C. After triethylthiourea and 4-hydroxy-6-methyl-(1,3,3a,7)-tetraazaindene were added, the sensitizing dye was added and agitation was continued for 30 minutes to achieve optimum chemical sensitization. The optimum chemical sensitization means that a maximum sensitivity is achieved without incurring fog. A monodispersed emulsion of octahedral grains having a mean particle size of 0.27 μm and a coefficient of variation of 10.7% was obtained in a yield of 635 grams.

TABLE 4

| | |
|---|---|
| $H_2O$ | 620 cc |
| Gelatin | 20 g |
| KBr | 0.03 g |
| $H_2SO_4$ (1N) | 16 cc |
| Compound A* | 0.015 g |
| pH 3.9 | |
| Temperature 75° C. | |

*Compound A is the same as in Table 1.

TABLE 5

| | Solution | | | |
|---|---|---|---|---|
| | I | II | III | IV |
| $AgNO_3$ | 30.0 g | — | 70.0 g | — |
| KBr | — | 21 g | — | 49.1 g |
| KI | — | 0.9 g | — | 2.1 g |
| $K_2IrCl_6$ | — | — | — | $4.0 \times 10^{-5}$ g |
| Water totaling to | 150 cc | 150 cc | 350.2 cc | 350.2 cc |

For comparison purposes, photosensitive material No. 115 was fabricated by the same procedure as photosensitive material No. 100 except that in the preparation of the emulsion for the third layer, emulsion (2) was replaced by emulsion (4).

For comparison purposes, photosensitive material No. 116 was fabricated by the same procedure as No. 115 except that in the preparation of the emulsion for the third layer, 25 ml of an aqueous 1% KI solution was added 1 minute later from the end of addition of Solutions III and IV.

Photosensitive material No. 117 was fabricated by the same procedure as No. 100 except that in the preparation of the emulsion for the first layer, 25 ml of an aqueous 1% KI solution was added 1 minute later from the end of addition of Solutions III and IV.

Preparation of dye-fixing material

A dye-fixing material was prepared by laying up components on a polyethylene-laminated paper support in accordance with the formulation shown in Table 6.

TABLE 6

| Dye-fixing material | |
|---|---|
| Additives | Coating weight (g/m²) |
| 3rd layer: | |
| Gelatin | 0.05 |
| Silicone oil*1 | 0.04 |
| Surfactant*2 | 0.001 |
| Surfactant*3 | 0.02 |
| Surfactant*4 | 0.10 |
| Guanidine picolinate | 0.45 |
| Polymer*5 | 0.24 |
| 2nd layer: | |
| Mordant*6 | 2.35 |
| Polymer*7 | 0.60 |
| Gelatin | 1.40 |
| Polymer*5 | 0.21 |
| High-boiling solvent*8 | 1.40 |
| Guanidine picolinate | 1.80 |
| Surfactant*2 | 0.02 |
| 1st layer: | |
| Gelatin | 0.45 |
| Surfactant*4 | 0.01 |
| Polymer*5 | 0.04 |
| Hardener*9 | 0.30 |
| Support: polyethylene-laminated paper of 170 μm thick | |
| 1st black layer | |
| Gelatin | 3.25 |
| Hardener*9 | 0.25 |
| 2nd black layer | |
| Gelatin | 0.44 |
| Silicone oil*1 | 0.08 |
| Surfactant*2 | 0.002 |
| Matte agent*10 | 0.09 |
| Surfactant*11 | 0.01 |

The components in Table 6 have the structural formulae shown below.

*1Silicone oil: 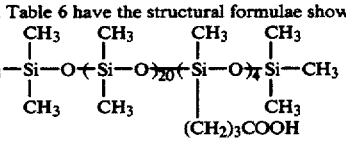

*2Surfactant: Aerosol OT

*3Surfactant: $C_8F_{17}SO_2N(C_3H_7)CH_2COOK$

*4Surfactant: $C_{11}H_{23}CONHCH_2CH_2CH_2N^{\oplus}(CH_3)_2CH_2COO^{\ominus}$

*5Polymer: vinyl alcohol/sodium acrylate copolymer (75/25 molar ratio)

*6Mordant: 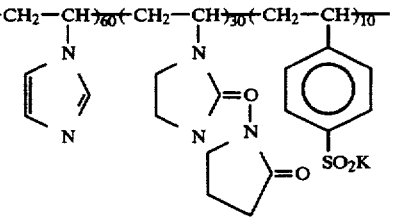

*7Polymer: dextran (molecular weight 70,000)

*8High-boiling solvent: Rheophos 95 (Ajinomoto K.K.)

*9Hardener: 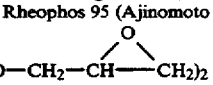

*10Matter agent: benzoguanamine resin (18% by volume of particles of more than 10 μm size)

*11 Surfactant: $C_8F_{17}SO_2N(C_3H_7)(CH_2CH_2O)_n(CH_2)_4SO_3Na$ (n − 4)

These photosensitive materials were evaluated by the following exposure and processing. Using a laser exposure apparatus as described in Japanese Patent Application No. 129625/1990, each photosensitive material was exposed under the following conditions.

Exposure conditions

Beam intensity on photosensitive material surface: 1 mW

Scanning line density: 800 dpi (32 rasters/mm)

Beam diameter:

100±10 μm in main scanning direction

80±10 μm in subordinate scanning direction

Exposure time: 0.9 msec./raster

Exposure wavelength: 670, 750, 810 nm (laser light)

Exposure quantity: a variation of 1 logE/2.5 cm in subordinate scanning direction (maximum 80 erg/cm², minimum 1.2 erg/cm²)

Exposure quantity control: light emitting time modulation

After 12 cc/m² of water was supplied to the emulsion surface of the exposed photosensitive material by means of a wire bar, a dye fixing material was placed on the wet photosensitive material such that their effective surfaces contacted each other. Using a heating drum, the assembly was heated such that the water-absorbed coating reached a temperature of 90° C. for 20 seconds. The dye fixing material which now born an image thereon was then stripped from the photosensitive material.

Spectral sensitivity was measured by exposing each photosensitive material to monochromatic light for 5 seconds through a wedge and thereafter carrying out the same procedures as above.

With respect to transfer density, fog and sensitivity (the inverse of an exposure providing a fog of +1.0) were measured using an auto-recording densitometer.

The aging stability of an emulsion coating composition in solution form was evaluated by comparing photographic properties between a sample coated with a fresh emulsion coating composition and a sample coated with an emulsion coating composition which was agitated for 4 hours at 40° C. after preparation.

In accordance with the above-defined procedures, photosensitive material Nos. 100 to 116 were measured for sensitivity and fog of a cyan color developing layer. The results are shown in Table 7. Photosensitive material Nos. 100 and 117 were measured for sensitivity and fog of a yellow color developing layer, with the results shown in Table 8.

Sensitivity and fog were measured on both a sample coated with a fresh emulsion coating composition and a sample coated with an emulsion coating composition which was agitated for 4 hours at 40° C. after preparation. Sensitivity is expressed in relative sensitivity based on a sensitivity of 100 for photosensitive material No. 100 coated with a fresh emulsion coating composition.

TABLE 7

| Photo-sensitive material | Cyan color developing layer: Coated with fresh emulsion coating composition | | Coated with 40° C./4 hr. aged emulsion coating composition | |
|---|---|---|---|---|
| | Sensitivity | Fog | Sensitivity | Fog |
| 100* | 100 | 0.12 | 42 | 0.16 |
| 101 | 140 | 0.14 | 115 | 0.15 |
| 102 | 148 | 0.13 | 120 | 0.13 |
| 103 | 153 | 0.13 | 129 | 0.13 |
| 104 | 173 | 0.13 | 136 | 0.13 |
| 105 | 187 | 0.12 | 157 | 0.12 |
| 106 | 180 | 0.11 | 162 | 0.11 |
| 107 | 157 | 0.12 | 134 | 0.12 |
| 108 | 140 | 0.14 | 129 | 0.14 |
| 109 | 151 | 0.12 | 136 | 0.12 |
| 110 | 149 | 0.12 | 135 | 0.12 |

TABLE 7-continued

| Photo-sensitive material | Cyan color developing layer: Coated with fresh emulsion coating composition | | Coated with 40° C./4 hr. aged emulsion coating composition | |
|---|---|---|---|---|
| | Sensitivity | Fog | Sensitivity | Fog |
| 111 | 142 | 0.14 | 121 | 0.14 |
| 112 | 187 | 0.14 | 171 | 0.14 |
| 113 | 145 | 0.12 | 130 | 0.12 |
| 114* | 82 | 0.15 | 30 | 0.17 |
| 115* | 70 | 0.13 | 58 | 0.13 |
| 116* | 65 | 0.13 | 59 | 0.13 |

*outside the scope of the invention

TABLE 8

| Photo-sensitive material | Yellow color developing layer: Coated with fresh emulsion coating composition | | Coated with 40° C./4 hr. aged emulsion coating composition | |
|---|---|---|---|---|
| | Sensitivity | Fog | Sensitivity | Fog |
| 100* | 100 | 0.10 | 72 | 0.11 |
| 117 | 128 | 0.09 | 107 | 0.09 |

*outside the scope of the invention

All the photosensitive material samples (Nos. 100–116) showed a maximum spectral sensitivity (S0) of the cyan color developing layer at a wavelength of from 750 to 751 nm. For the photosensitive material samples coated with a fresh emulsion coating composition, the ratio (S1/S0) of the spectral sensitivity (S1) to light having a wavelength 20 nm longer than the wavelength giving the maximum spectral sensitivity to the maximum spectral sensitivity (S0) was from 0.01 to 0.02, indicating that S1 was substantially less than ⅓ of S0. All the photosensitive material samples, Nos. 101–113 showed no change in spectral sensitivity profile even when the emulsion coating compositions were aged over 4 hours at 40° C. after their preparation. In contrast, sample Nos. 100 and 114–116 showed a broad spectral sensitivity profile over the wavelength range of 720 to 730 nm.

Control sample No. 100 and inventive sample No. 117 showed a S1/S0 ratio for the yellow color developing layer of 0.47 and 0.45, respectively.

These results, combined with the results of Tables 7 and 8, show that the photosensitive materials of the invention exhibit high sensitivity and low fog while the corresponding emulsion coating composition in solution form remains stable with time.

While there have been described herein what are considered to be preferred embodiments of the present invention, other modifications of the invention shall be apparent to those skilled in the art from the teachings herein. It is, therefore, desired to be secured in the appended claims all such modifications as fall within the true spirit and scope of the invention.

I claim:

1. A heat-developable color photosensitive material comprising at least a photosensitive silver halide emulsion, a binder and a dye-providing compound on support, said photosensitive material comprising at least one infrared-sensitive layer having a maximum spectral sensitivity at a wavelength of 700 nm or longer, said at least one infrared-sensitive layer containing a silver chlorobromide emulsion prepared by adding an iodide at an intermediate stage during grain formation or later;

wherein said infrared-sensitive layer containing a silver chlorobromide emulsion is spectrally sensitized with a thiadicarbocyanine sensitizing dye of the following general formula such that the spectral sensitivity to light having a wavelength 20 nm longer than the wavelength giving the maximum spectral sensitivity is up to one third of the maximum spectral sensitivity

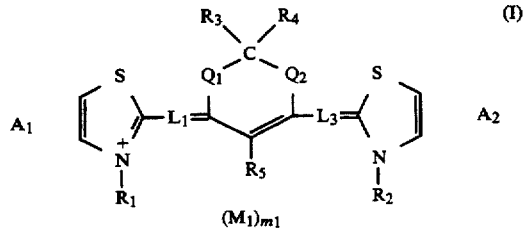

(I)

wherein $Q_1$ and $Q_2$ each are a methylene radical, $R_1$ and $R_2$ each are an alkyl radical, $R_3$, $R_4$ and $R_5$ are independently selected from the group consisting of a hydrogen atom, an alkyl radical, an aryl radical and a heterocyclic radical, with the proviso that both $R_3$ and $R_4$ are not hydrogen atoms at the same time, $L_1$ and $L_3$ each are a methine radical, $A_1$ and $A_2$ each are a group of atoms necessary to form a benzene or naphthalene ring, $R_1$ and $L_1$, and $R_2$ and $L_3$, taken together, may form a ring, $M_1$ is an electric charge balancing counter ion, and $m_1$ is a value necessary to neutralize the electric charge.

2. The photosensitive material of claim 1 wherein said silver chlorobromide emulsion contains iridium.

* * * * *

UNITED STATES PATENT AND TRADEMARK OFFICE

CERTIFICATE OF CORRECTION

PATENT NO. : 5,362,601

DATED : November 8, 1994

INVENTOR(S) : Kiyoteru Miyake

It is certified that error appears in the above-indentified patent and that said Letters Patent is hereby corrected as shown below:

Column 34, lines 25-33,

In claim 1, the structural formula shown below:

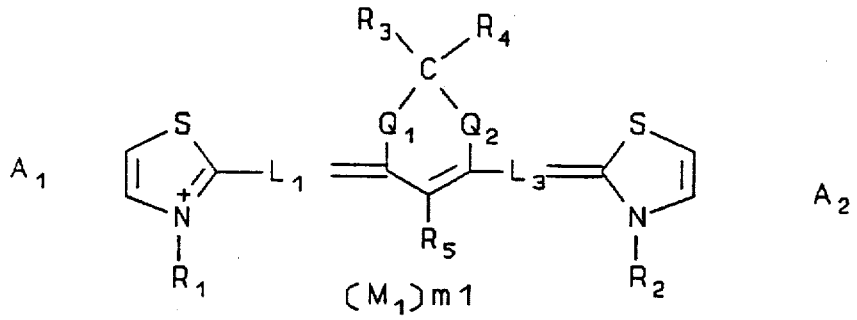

UNITED STATES PATENT AND TRADEMARK OFFICE

CERTIFICATE OF CORRECTION

PATENT NO. : 5,362,601

DATED : November 8, 1994

INVENTOR(S) : Kiyoteru Miyake

It is certified that error appears in the above-indentified patent and that said Letters Patent is hereby corrected as shown below:

should be replaced with the following corrected structural formula:

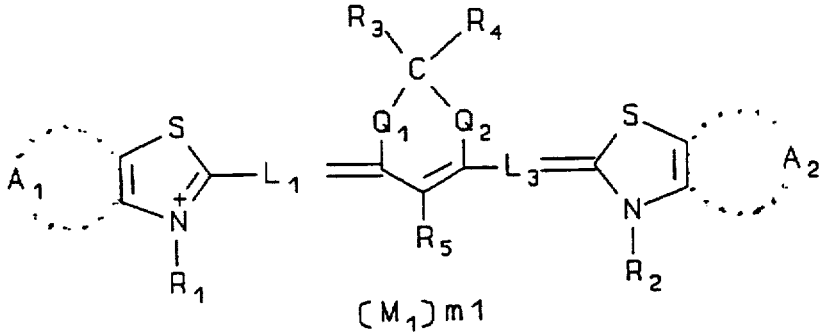

Signed and Sealed this

Fourteenth Day of March, 1995

*Attest:*

BRUCE LEHMAN

*Attesting Officer*

*Commissioner of Patents and Trademarks*